US009702182B2

(12) United States Patent
Wexler

(10) Patent No.: US 9,702,182 B2
(45) Date of Patent: Jul. 11, 2017

(54) FLOOD BARRIER SHIELD SYSTEM

(71) Applicant: Schlage Lock Company LLC, Carmel, IN (US)

(72) Inventor: Jacob Wexler, Scarsdale, NY (US)

(73) Assignee: Schlage Lock Company LLC, Indianapolis, IN (US)

( * ) Notice: Subject to any disclaimer, the term of this patent is extended or adjusted under 35 U.S.C. 154(b) by 0 days.

(21) Appl. No.: 14/551,875

(22) Filed: Nov. 24, 2014

(65) Prior Publication Data

US 2016/0145861 A1 May 26, 2016

(51) Int. Cl.
*E06B 3/26* (2006.01)
*E06B 9/02* (2006.01)
*E06B 9/00* (2006.01)

(52) U.S. Cl.
CPC ..... *E06B 9/02* (2013.01); *E06B 2009/007* (2013.01)

(58) Field of Classification Search
CPC . E06B 7/2318; E06B 9/00; E06B 9/02; E06B 2009/007
USPC ..... 52/202, 208, 169.14; 405/104, 106
See application file for complete search history.

(56) References Cited

U.S. PATENT DOCUMENTS 2,683,354 A * 7/1954 Camphausen ..... E02B 7/54 405/104
3,161,229 A * 12/1964 Sanders ..... E06B 7/2318 160/199
3,796,010 A * 3/1974 Carlson ..... E06B 7/2318 405/106
3,861,081 A * 1/1975 Maskell ..... E06B 9/00 405/104
4,682,443 A 7/1987 Demo
5,048,587 A * 9/1991 York ..... E06B 9/52 160/105
5,077,945 A 1/1992 Koeniger
5,184,358 A * 2/1993 Gruidel ..... A47K 3/006 277/647
6,363,670 B1 4/2002 Dewitt
2011/0154752 A1 6/2011 Grover et al.
2013/0061522 A1 3/2013 Alexander et al.

OTHER PUBLICATIONS

Zero Compress-O-Matic, Model 770AA (On sale prior to Nov. 24, 2013).

* cited by examiner

*Primary Examiner* — Basil Katcheves
(74) *Attorney, Agent, or Firm* — Taft Stettinius & Hollister LLP

(57) ABSTRACT

A flood barrier shield system for installation in a building opening such as a door frame includes a water impervious panel having a base edge and at least two side edges generally complementary in shape to the base and side edges of the opening into which it is to be installed. Channel shaped seal housings are mounted on the panels adjacent its base and side edges which contain seal bars consisting of a relatively rigid bar having a flexible seal mounted thereon and extending the length of the housing. The seal is located to face the opposing surface of the opening and the bar is connected to the housing by selectively operable devices which move the bar and seal between retracted and extended position for ease of positioning the flood barrier in the opening and then forming a water tight seal along the base and sides of the system.

29 Claims, 4 Drawing Sheets

FLOOD BARRIER SHIELD SYSTEM

FIELD OF THE INVENTION

The present invention relates to a flood barrier shield system for doors, windows or similar building openings, and more particularly, to a system which is light weight easily installed and removed in a building opening.

BACKGROUND OF THE INVENTION

Because of the periodic flooding of low lying areas during hurricanes or severe rain storms or other uncontrolled releases of flooding water from dams, lakes or the like there is a recognized need for temporary flood protection devices which can seal off doorways, windows or other building openings to prevent the entry of water.

Typically the flooding is most frequently moderate with inundations of a few inches or feet. Conventional doors or windows are not designed to prevent water entry through the structures adjoining the openings, e.g., where a door meets the jambs or sill. Thus water, even just a few inches high, can enter the building and cause severe damage and mold. Such incidents frequently occur unexpectedly or with short notice and are of short durations and thus only require temporary protection. This has been attempted in the past by the use of sand bags placed at base of the building openings or surrounding the entire property. These solutions do not provide true seals, are expensive and installation is time consuming.

Improved sealing has been proposed in place of sand bags in the past. For example, the assignee of this application, Zero International, has offered a flood barrier Model 2070 which consists of aluminum channel brackets that are premounted on a door frame with their open sides facing each other. This allows a flat aluminum panel or shield having neoprene rubber seals on its side and bottom edges to be slid into the channels. The neoprene seals provide a water seal in the channels and against the door sill. While this system has been successful in use, it required either leaving the channels permanently in place, which may interfere with normal door use and which some may consider unsightly, or removal of the channels leaving visible mounting holes in the door jambs. In addition this system may not completely seal a doorway which is not "square", i.e. when the jambs and sill are not precisely perpendicular to each other or where the channels are not mounted in proper alignment. In addition the permanently installed channels collect dirt and debris and thus require periodic maintenance.

Other attempts to provide flood barrier shields include the use of rigid panels having inflatable tubes mounted on the side and bottom edges of the panel. Such panels are disclosed in U.S. Pat. No. 4,682,443 to Demo and U.S. Pat. No. 5,077,945 to Koeniger. These units are installed in a doorway with their inflatable tubes deflated. Once positioned the tubes must be inflated, which requires time consuming operation of a pump. Such devices are heavy and do not allow for seal adjustment to accommodate and seal misaligned door jambs and sills. The inflated tubes will flatten at the corners of these barriers and thus will not properly seal those corners. In addition, during a storm operation of an electric air pump creates its own hazards.

SUMMARY OF THE INVENTION

It is an object of the invention to provide a light weight flood harrier for building openings which is easily installed for temporary use.

Another object of the invention is to provide a removable flood barrier which provides improved sealing and is adjustable to accommodate variations in the alignment of the elements of the building opening to be sealed.

Yet another object of the invention is to provide a flood barrier which can be installed and removed quickly and easily.

A further object of the invention is to provide a flood barrier which is inexpensive and simple to manufacture.

In accordance with an aspect of the present invention a flood barrier shield system is provided which consists of a single unit including a main shield element or panel having top, bottom and opposite side edges and also having seal housings mounted on each of the side and bottom edges. The seal housings each include a seal adjustment bar movably mounted in the housing and having a flexible seal element mounted therein and facing out of the seal housing to contact the sides and bottom of a building opening when installed. The seal adjustment bars are secured to their respective housing by adjustment devices, e.g. screws, which when operated will move the adjustment bar and seal between extended and retracted positions. With the seal bars in the retracted position the flood barrier is easily and quickly positioned in the opening to be sealed. Once positioned, the adjustment devices can be operated to move the seal bars to their extended position to press the seals in water tight relation against the adjacent surfaces of the opening. Because multiple adjustment devices are provided on each seal bar, the adjustment devices will cause the seal to extend as required along its length to accommodate variations from square alignment of the adjacent surfaces of the opening.

The seal itself is a solid flexible neoprene strip preferably having an air-tight internal chamber to allow the seal to flex and flatten to form a tight seal when the adjustment bars are extended. This also helps further accommodate misalignments in the building opening frame. In addition, the seal is formed from strips of the seal material which are mitered at the corners of the shield and vulcanized together at the mitered ends, so the seal fully occupies the corner of the opening to seal it.

With the above described structure the flood barrier of the invention can be installed in seconds and provide improved sealing and flood protection.

The above and other object, features, and advantages of this invention will be apparent to those skilled in the art from the following detailed description of an illustrative embodiment thereof which is to be read in connection with the accompanying drawings wherein:

DETAILED DESCRIPTION OF THE INVENTION

Figure 1:
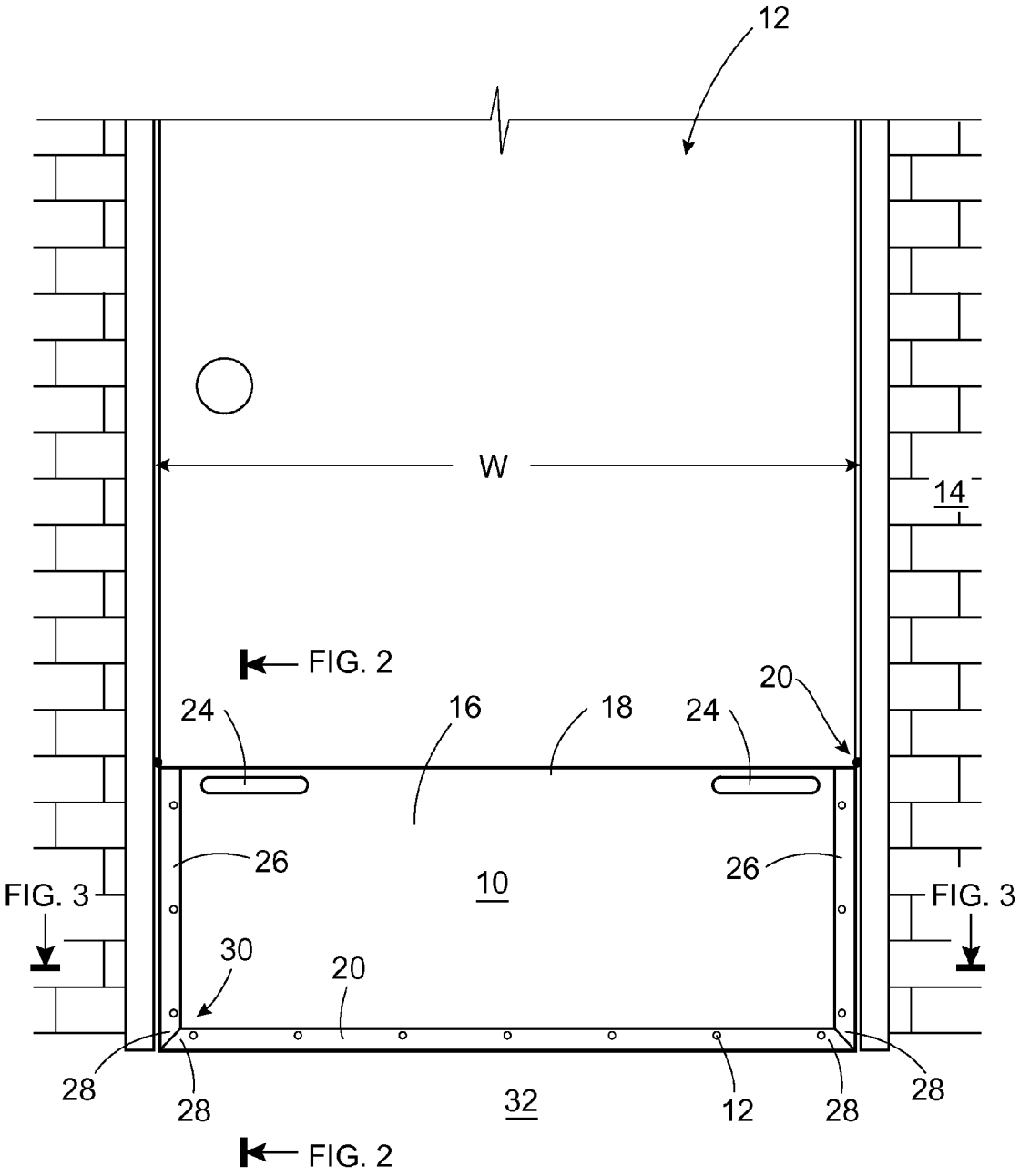
FIG. 1 is an elevational view of a building opening in the form of a doorway having a flood barrier shield system according to the present invention mounted therein.
Figure 2:
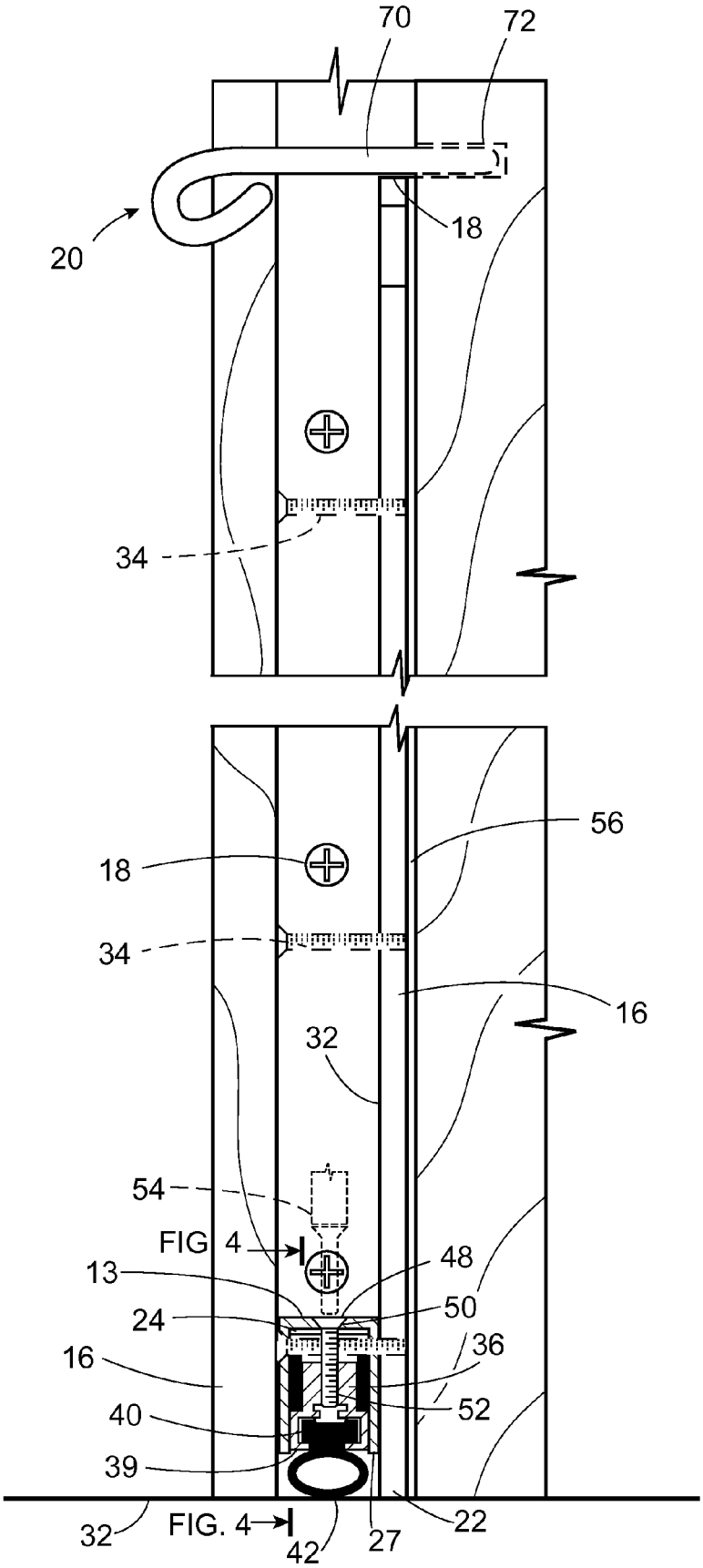
FIG. 2 is a sectional view taken along line 2-2 of FIG. 1 showing the seal housing on the bottom of the flood barrier shield system in section and one of the side seal housing in elevation.
Figure 3:
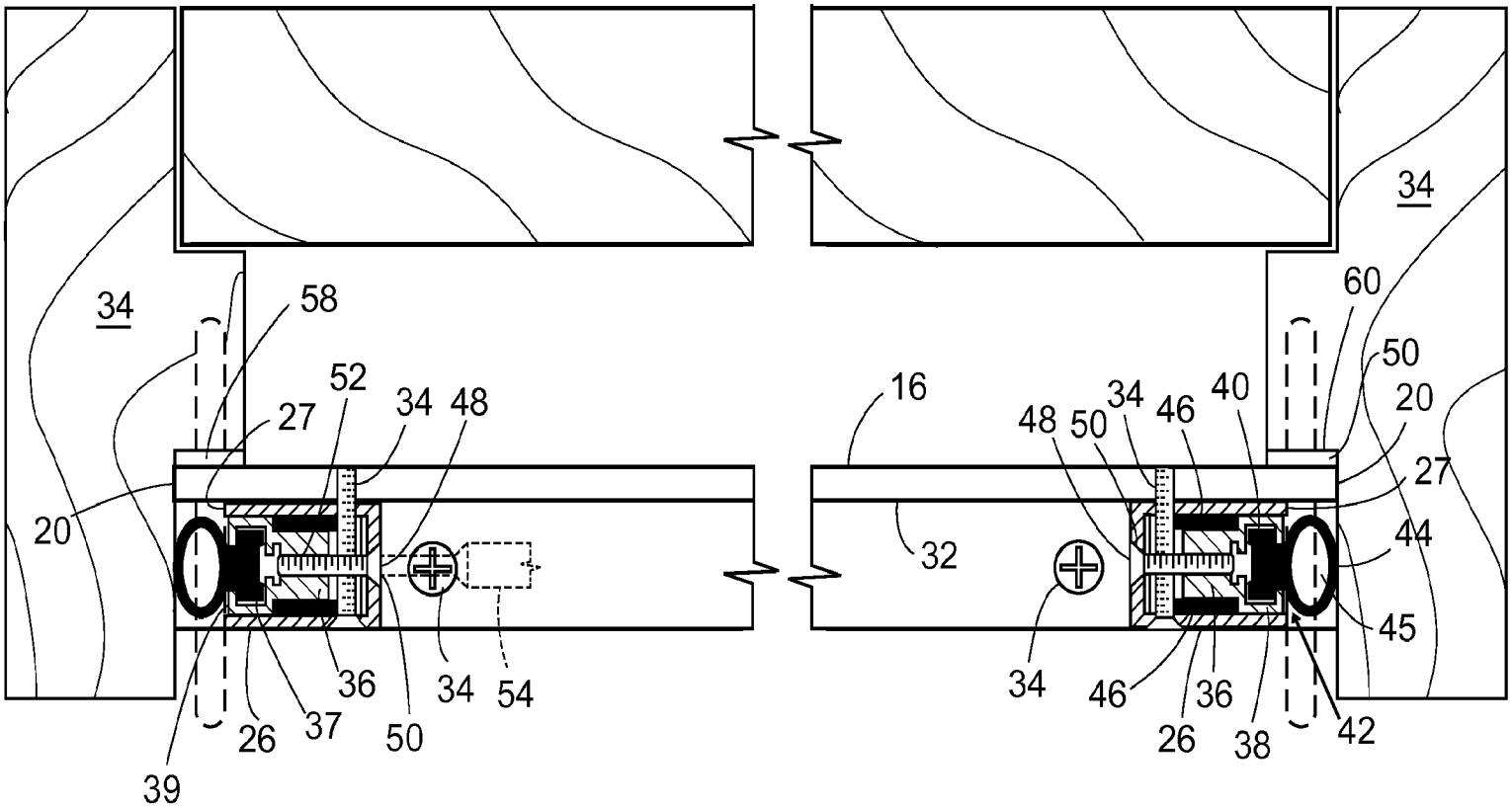
FIG. 3 is a sectional view taken along line 3-3 of FIG. 1 showing the side seal housings in sections and the bottom seal housing in place.

Referring now to the drawing in detail and initially to FIG. 1 a flood barrier shield system 10 according to the present invention is illustrated as installed in an opening 12 of a building 14. In FIGS. 1-3 the opening 12 is illustrated as a doorway, however it will be understood that the barrier can also be sized and used for sealing other openings in the building such as windows and garage doors.

Flood barrier shield system 10 includes a main shield or panel 16 which is preferably formed of aluminum but which could be formed of other water impervious materials including wood or plastic. The panel 16 is of course formed in a size approximately the same as the width of the opening. More specifically, the width of the panel is selected to be slightly less (up to about 7/16 of an inch less) than the width W of the opening to be sealed. The height may be made to cover a part or all of the height of the opening as desired.

Panel 16 as illustrated is intended for a rectangular or square opening but the panel and shield can be formed, according to the invention, in any shape as needed for a particular opening, e.g. hexagonal or triangular. As illustrated panel 16 has a top edge 18, side edges 20 and bottom edge 22. Oval or other shaped openings 24 are formed in panel 16 below top edge 18 to enable the panel to be manually grasped by the user for ease of installation or removal.

Panel 16 also has seal housings 26 mounted on its side and bottom edges 20, 22. The seal housings 26 are essentially identical except for length and are shown in section in FIGS. 2 and 3. They are preferably formed of aluminum and their abutting ends 28 are mitered at the lower comers 30 of panel 16 to closely abut one other. If desired these joints can be welded or otherwise sealed with conventional waterproofing sealant materials to further ensure no water enters therethrough when in use. However, the seal arrangement described hereinafter will produce a water tight seal without welding or other sealing of the housing ends at the miters.

Seal housings 26 are removably secured to the outer face 32 of panel 16, i.e. the surface facing away from the building and are secured thereto by screws 34. This allows for ease of repair or replacement of the elements contained in the housing hereinafter described. Alternatively however the housings may be permanently fixed to the panel by welding or the like; or they can be secured on the inner face of the panel bur in some installations that may cause interference with the door.

As seen in FIGS. 2 and 3 each housing 26 is a generally U shaped channel positioned on panel 16 so that its open end 27 will face the adjacent frame element of the building opening it faces when installed. As illustrated therein the opening 27 of the seal housing on the bottom edge of panel 16 faces the base of the opening which in the illustrated embodiment is the sill 32 of the door opening and the opening of the seal housings 26 on the sides 20 of panel 16 face the sides of the opening, e.g. the door jambs 34.

As also seen in FIGS. 2 and 3 a seal adjustment bar 36 (also referred to as a seal bar herein) is located in each of the seal housings. The seal bars extend the length of the housing they are located in and are formed of aluminum or other suitable material. Preferably, the seal bars are rigid but may have some flexibility to bend slightly to comply or conform with the opening surfaces when forming a seal. Each seal bar includes a channel 38 formed therein which receives the complementary shaped head 40 of a neoprene seal 42. Seal 42 extends the length of its associated seal bar 36 and includes grooves 37 below its head 40 which is formed to an oval seal section 44 positioned to contact the facing surface of the door opening. Oval seal section 44 is formed with a hollow air tight chamber 45 which gives the seal additional flexibility when engaged with the facing door opening surfaces to conform to the surfaces and form a tight seal. The seal bars 36 include legs 39 received in grooves 37 which retain the seal 42 in the channel but allow the seal to slide in the channel.

Figure 4:
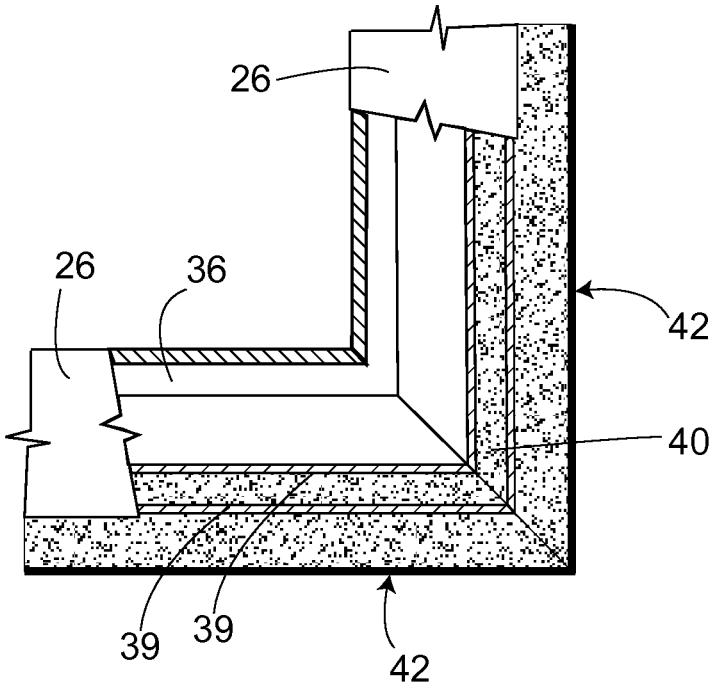
FIG. 4 is an elevational view of the lower right corner of the shield shown in FIG. 1 with the outer channel partly removed and the interior shown in sections along line 4-4 of FIG. 2.

FIG. 4 illustrates the structure of the shield system at the corners. As seen therein the housings 26 are mitered at their ends as are the seal bars 36 and seals 42. FIG. 4 shows the seal bars in their retracted positions. The mitered ends of the seals 42 are secured together in water sealing relation by vulcanizing the ends using known vulcanizing techniques to form a unitary structure. The seals 42 are flexible so the shape of the oval seal sections remain substantially the same when the seal is put in place as described hereinafter.

Seal bars 36 also include neoprene strips 46 mounted along their longitudinal sides by adhesives or in any other convenient manner. Strips 46 serve to facilitate sliding movement of seal bars 36 as described hereinafter and also serve to seal the interior of housing against water entry.

Seal bars 36 are mounted for movement between extended and retracted positions in their respective housings by a plurality of screws 48 positioned in openings 50 in the seal housings and threaded engaged in threaded holes 32 in the seal bars. As a result when the screws 48 are turned by a screw driver 54 (shown in phantom lines in FIGS. 2 and 3) the engagement with the seal bar causes the bar to act as a nut. Thus turning the screws in one direction will draw the bar at that screw into the housing and turning in the opposite direction will urge the bar out of the busing to engage the opposing surface of the opening the barrier shield is placed in. Because the seal strips 42 are vulcanized together at their mitered ends even if the bottom and side seal bars are not extended to the same extent the joined corner formed at the mitered end retains its shape as the seals slide in channels 38 to fully fill the corner of the opening to prevent water incursions.

Panel 16 also has a rear surface 56 which will face the opening, in the illustrated case a door, when installed. The rear surface has additional neoprene seal strips 58 secured thereto along its side edges 20 to engage a return surface 60 if any is provided, on the door frame. The seals 58 are secured with an appropriate adhesive and provide additional sealing protection where the door frame has a suitable return.

In operation the flood barrier shield system of the invention is installed in the building opening with its seal bars retracted so the system can easily be seated in the opening with the back seals against the return 60 if available. The user then operates the screws 48, serially or otherwise, to drive the seal bars towards their extended positions. This urges the seal section 44 against the facing surfaces of the opening. Because of the multiple screws 48 used with each seal bar, the system allows the seal bar to adjust to the adjacent surface to accommodate irregularities or misalignment of the openings adjacent surfaces from "squares." The installation takes a minimal of time to complete.

Because the system is light, it is conceivable that in some circumstances extension of the seal bar on the bottom of the panel may cause the entire panel to move upwardly. Such upward movement would reduce the effectiveness of the bottom seal. To overcome that possibility a latch pin 70 is provided with the system to be inserted above the top edge 18 of panel 16 into a hole 72 bored in the door jamb (see FIG. 2).

This pin (or pins as two are provided, FIG. 3) will prevent the system from moving up when the bottom seal is extended. Such pins are not required to resist lateral shifting since the two side seal bars oppose each other and resist such movement. Alternatively separate pin latches can be mounted on the outer surface of panel 16 that can be inserted in holes 72.

Although illustrative embodiments of the present invention have been described herein with reference to the accompanying drawings, it is to be understood that various changes and modifications may be affected therein by those skilled in the art without departing from the scope or spirit of this invention.

What is claimed is:

1. A flood barrier shield system for installation in a building opening having a base and at least two side portions defining a lower portion of the opening, said flood barrier shield system comprising:

a water impervious panel having a base edge and at least two side edges generally complementary in shape and slightly shorter than the lengths of the base and side portions of the opening into which it is to be installed; said panel having a front and rear faces respectively facing away from and towards the building opening when installed therein;

seal housings mounted on the panel adjacent each of the base edge and side edges of the panel; said seal housings having an outwardly facing opening formed therein positioned to respectively face the base and side portions of the building opening when installed therein;

seal bars mounted in each of said housings including a seal mounting bar and a flexible seal mounted on said bar to extend from the seal housing opening to contact the base and side portions of the building opening when installed therein; and means for securing said seal mounting bars to their associated seal housing and for selectively moving said seal bars and seals mounted there between retracted and extended positions relative to said seal housing openings;

wherein said side edges meet said base edge at corners, and wherein said seal housings, seal bars and flexible seals are mitered at said corners, said seals being sealed together at their mitered ends without materially changing the seal shape at the mitered ends, whereby seal ends fill corners of the building opening when installed therein.

2. The flood barrier shield system as defined in claim 1 including seal strips mounted on the seal bars above the flexible seals to form a seal between the bars and the interior of the seal housings.

3. The flood barrier shield system as defined in claim 2 wherein said flexible seal includes a hollow airtight seal portion for contacting the base and side portions of the building opening when installed therein.

4. The flood barrier shield system as defined in claim 3 wherein said seal housings are mounted on the front faces of the panel and said system includes additional seal strips mounted on the rear surface of said panel adjacent the panel edges.

5. The flood barrier shield system as defined in claim 4 wherein said panel includes a hand opening therein spaced from its bottom edge to facilitate installation in the building opening.

6. The flood barrier shield system as defined in claim 1 wherein said securing means comprises a plurality of screws positioned in openings in said housing, said screws having threaded shanks engaged in threaded holes formed in said seal mounting bars.

7. The flood barrier shield system as defined in claim 1 including means for preventing upward movement of the flood barrier shield system when said securing means is operated to move the seal bar in the seal housing secured adjacent the base edge of the panel to its extended position.

8. The flood barrier shield system as defined in claim 7 wherein said preventing means is a rigid pin engaged between the shield and an adjacent surface of the building opening.

9. A flood barrier shield system for installation in a building opening having a base sill portion and at least two side jamb portions defining a lower portion of the opening, said flood barrier shield system comprising:

a water impervious panel member having a base edge and at least two side edges generally complementary in shape and slightly shorter than the length of the base sill and two side jamb portions of the building opening into which the shield is to be installed; said panel having a front and a rear face respectively facing away from and towards the building opening when installed therein;

seal housings mounted on the front surface of the panel adjacent each of the base edge and side edge of the panel; said seal housings comprising generally U shaped channels mounted such that the opening between the channel legs face outwardly towards the base sill and side jamb portions of the building opening when installed therein;

seal devices mounted in each of said channel shaped housing each including a relatively rigid seal mounting bar and a flexible seal mounted on said relatively rigid seal mounting bar to extend from the seal mounting bar through the opening between the legs of its associated channel shaped seal housing to contact the base sill and side jamb portions of the building opening when installed therein;

said seal housings having a plurality of screw openings formed in a blight portion of the housing and said relatively rigid seal mounting bars having screw threaded openings formed therein aligned with the screw openings in the seal housing; and threaded screws positioned in said screw openings and having threaded shafts engaged in the threaded openings of the seal mounting bars whereby rotation of said screws in said threaded openings will move the adjacent portion of the seal mounting bar between extended and retracted positions relative to the opening between the channel legs to press the seals at the edges of the system against the base sill and side jamb portions of the building opening in which it is installed to seal the same against water intrusion and accommodate misalignments of said base sill and side jamb portions;

wherein said side edges meet said base edge at corners, and wherein said seal housings, seal bars and flexible seals are mitered at said corners, said seals being sealed together at their mitered ends without materially changing the seal shape at the mitered ends, whereby seal ends fill corners of the building opening when installed therein.

10. The flood barrier shield system as defined in claim 9 wherein said seal mounting bars have side surfaces parallel to the inner surfaces of the legs of said channels and seal strips mounted on said side surfaces and engaging said inner surfaces of the channels to form a water seal therebetween.

11. The flood barrier shield system as defined in claim 10 wherein said flexible seal includes a hollow airtight seal portion for contacting the base and side portions of the building opening when installed therein.

12. The flood barrier shield system as defined in claim 11 including additional seal strips mounted on the rear surface of said panel adjacent the panel edges.

13. The flood barrier shield system as defined in claim 12 wherein said panel includes a hand opening therein spaced from its bottom edge to facilitate installation in the building opening.

14. The flood barrier shield system as defined in claim 9 including means for preventing upward movement of the flood barrier shield system when said securing means is operated to move the seal bar in the seal housing secured adjacent the base edge of the panel to its extended position.

15. The flood barrier shield system as defined in claim 14 wherein said preventing means is a rigid pin engaged between the shield and an adjacent surface of the building opening.

16. A flood barrier shield system for installation in a building opening, wherein the building opening is defined at least in part by a plurality of inwardly-facing building surfaces, said flood barrier shield system comprising:

a panel having a plurality of panel edges, wherein each of the panel edges corresponds to one of the building surfaces, and wherein each panel edge has a length that is shorter than the corresponding building surface;

a plurality of seal housings, wherein each seal housing is mounted on the panel adjacent a corresponding one of the panel edges, wherein each seal housing includes an outwardly-facing seal housing opening and a fastener opening;

a plurality of seal bars, wherein each seal bar is mounted in a corresponding one of the seal housings, wherein each seal bar extends outwardly through the seal housing opening of the corresponding seal housing, wherein each seal bar includes a mounting bar and a flexible seal mounted on the mounting bar, wherein each mounting bar includes a threaded opening aligned with the fastener opening of the corresponding seal housing, and wherein each seal bar includes at least one mitered end; and a plurality of fasteners, wherein each fastener extends through one of the fastener openings into a corresponding one of the threaded openings, wherein each fastener includes a head engaged with a corresponding one of the seal housings and a threaded shank engaged with the corresponding one of the threaded openings;

wherein the shield has a sealing periphery defined by the seal bars, wherein the sealing periphery includes at least one corner, wherein two of the mitered ends are sealed together at each corner, and wherein the sealing periphery has an outer perimeter defined by the flexible seals;

wherein engagement between the threaded shank of each fastener and the threaded opening of a corresponding one of the seal bars is structured to move the seal bar in response to rotation of the fastener, thereby altering the outer perimeter of the sealing periphery.

17. The flood barrier shield system of claim 16, wherein each seal bar is structured to move in an outward direction in response to rotation of the corresponding fastener in a first rotational direction and to move in an inward direction in response to rotation of the corresponding fastener in a second rotational direction.

18. The flood barrier shield system of claim 17, wherein movement of the seal bars in the outward direction expands the sealing periphery, and wherein movement of the seal bars in the inward direction contracts the sealing periphery.

19. The flood barrier shield system of claim 16, wherein at each corner, the flexible seals of the seal bars are sealed together without materially changing a shape of the flexible seals at the mitered ends.

20. The flood barrier shield system of claim 16, wherein at each of the corners, the seal housings and the seal bars of the two sealing units are mitered and are joined to one another at their mitered ends.

21. The flood barrier shield system of claim 16, wherein each seal bar has an extended position in which the seal bar extends beyond the corresponding one of the panel edges and a retracted position in which the seal bar does not extend beyond the corresponding one of the panel edges, and wherein each seal bar is structured to move between the extended position and the retracted position in response to rotation of the corresponding fastener.

22. The flood barrier shield system of claim 21, wherein the plurality of panel edges includes a base edge and two side edges, wherein the base edge extends along a lateral direction, wherein each of the side edges extends along a transverse direction, wherein the seal bar corresponding to the base edge is structured to move in the transverse direction in response to rotation of the corresponding one of the fasteners, and wherein the seal bars corresponding to the side edges are structured to move in the lateral direction in response to rotation of the corresponding one of the fasteners.

23. A flood barrier shield system, comprising:

a panel including a plurality of panel edges, wherein each of the panel edges defines an inward direction and an outward direction;

a plurality of sealing units, wherein each sealing unit corresponds to one of the panel edges, and wherein each sealing unit comprises:

a seal housing mounted to the panel adjacent the corresponding panel edge, wherein the seal housing includes a seal housing opening facing in the outward direction of the corresponding panel edge;

a seal bar mounted in the seal housing, wherein the seal bar includes a mounting bar and a flexible seal, and wherein the flexible seal is mounted to the mounting bar; and at least one adjustment device including a threaded shank, wherein each adjustment device extends through a corresponding opening in the seal housing, wherein each threaded shank is engaged with a corresponding threaded opening in the mounting bar;

wherein, for each adjustment device, the engagement between the threaded shank and the corresponding threaded opening is structured to urge the seal bar in the inward and outward directions defined by the corresponding panel edge in response to rotation of the adjustment device;

wherein the seal bar has an extended position in which the flexible seal extends beyond the corresponding panel edge in the outward direction; and wherein the seal bar is structured to move between the extended position and a retracted position in response to rotation of the at least one adjustment device; and a plurality of corners, wherein two of the sealing units meet at each of the corners, and wherein at each of the corners, the flexible seals of the two sealing units are mitered and are sealed together at their mitered ends.

24. The flood barrier shield system of claim 23, wherein at each of the corners, the flexible seals of the two sealing units are sealed together at their mitered ends without materially changing the seal shape at their mitered ends.

25. The flood barrier shield system of claim 24, wherein at each of the corners, the seal housings and the seal bars of the two sealing units are mitered and are joined to one another at their mitered ends.

26. The flood barrier shield system of claim 23, wherein the plurality of edges includes a base edge and two side edges, wherein the base edge extends in lateral directions, and wherein each side edge extends in transverse directions, wherein the inward and outward directions defined by the base edge include the transverse directions, and wherein the inward and outward directions defined by the side edges include the lateral directions.

27. The flood barrier shield system of claim 26, wherein the plurality of sealing units includes a base sealing unit and two side sealing units, wherein the base sealing unit corresponds to the base edge, and wherein each of the side sealing units corresponds to one of the side edges;

wherein for the base sealing unit, the fastener seal bar is structured move in the transverse directions in response to rotation of the adjustment device; and wherein for each of the side sealing units, the seal bar is structured to move in the lateral directions in response to rotation of the adjustment device.

28. The flood barrier shield system of claim 23, wherein for each sealing unit, the flexible seal does not extend beyond the corresponding panel edge when the seal bar is in the retracted position.

29. The flood barrier shield system of claim 23, wherein for each of the sealing units, the at least one adjustment device comprises a plurality of the adjustment devices located at different positions along a length of the sealing unit.

* * * * *